US011802567B2

(12) United States Patent
Liang et al.

(10) Patent No.: US 11,802,567 B2
(45) Date of Patent: Oct. 31, 2023

(54) ADJUSTABLE BLADE OF IMPELLER BUILT-IN ELECTRIC PUMP

(71) Applicant: HEFEI HENGDA JIANGHAI PUMP CO., LTD., Hefei (CN)

(72) Inventors: Liang Liang, Hefei (CN); Qinglong Zhu, Hefei (CN); Xing Li, Hefei (CN); Lei Jin, Hefei (CN); Xiaojian Jia, Hefei (CN)

(73) Assignee: HEFEI HENGDA JIANGHAI PUMP CO., LTD., Hefei (CN)

( * ) Notice: Subject to any disclaimer, the term of this patent is extended or adjusted under 35 U.S.C. 154(b) by 0 days.

(21) Appl. No.: 17/780,537

(22) PCT Filed: Sep. 10, 2020

(86) PCT No.: PCT/CN2020/114549
§ 371 (c)(1),
(2) Date: May 27, 2022

(87) PCT Pub. No.: WO2021/253651
PCT Pub. Date: Dec. 23, 2021

(65) Prior Publication Data

US 2022/0412363 A1 Dec. 29, 2022

(30) Foreign Application Priority Data

Jun. 16, 2020 (CN) ..... 202010550947.5

(51) Int. Cl.
*F04D 15/00* (2006.01)
*F04D 29/18* (2006.01)
*F04D 13/06* (2006.01)

(52) U.S. Cl.
CPC ..... *F04D 15/0055* (2013.01); *F04D 13/0673* (2013.01); *F04D 29/181* (2013.01)

(58) Field of Classification Search
CPC ..... F04D 13/0646; F04D 13/0673; F04D 15/0055; F04D 27/002; F04D 29/181; F04D 29/323
See application file for complete search history.

(56) References Cited

U.S. PATENT DOCUMENTS 3,687,569 A * 8/1972 Klompas ..... F04D 29/323 416/207
5,494,413 A * 2/1996 Campen ..... F04D 29/669 417/423.12

(Continued)

FOREIGN PATENT DOCUMENTS

CN 1037567 A * 11/1989
CN 101787978 A 7/2010

(Continued)

OTHER PUBLICATIONS

Machine translation of CN 1037567, Pei Zhong, published Nov. 29, 1989 (Year: 1989).*

(Continued)

*Primary Examiner* — Juan G Flores
*Assistant Examiner* — Jason G Davis
(74) *Attorney, Agent, or Firm* — Bayramoglu Law Offices LLC

(57) ABSTRACT

An adjustable blade of an impeller built-in electric pump includes a blade body, where the blade body realizes an angle adjustment through a lever regulator structure. The lever regulator structure includes a control shaft arranged at a root of the blade body, the other end of the control shaft is connected to a crank, the other end of the crank is rotatably connected to one end of a connecting rod, the other end of the connecting rod is rotatably connected to an operating frame, and the operating frame is provided with a drive rod configured to drive the operating frame to move. The adjustable blade of the impeller built-in electric pump (Continued)

has the advantages of being compact and simple, low manufacturing cost and low difficulty of installation and maintenance. Moreover, by adjusting the angle of the blade, the vibration during the start-up of the unit can be effectively reduced.

5 Claims, 4 Drawing Sheets

(56) References Cited

U.S. PATENT DOCUMENTS

| | | | | |
|---|---|---|---|---|
| 9,708,914 | B2 * | 7/2017 | Fulayter | F01D 5/12 |
| 2007/0059161 | A1 | 3/2007 | Bouru | |
| 2018/0073375 | A1 * | 3/2018 | Iwakiri | F01D 5/02 |

FOREIGN PATENT DOCUMENTS

| | | | |
|---|---|---|---|
| CN | 103452866 | A | 12/2013 |
| CN | 204646769 | U | 9/2015 |
| CN | 106460538 | A | 2/2017 |
| CN | 110500319 | A | 11/2019 |
| CN | 210686324 | U | 6/2020 |
| CN | 111577650 | A | 8/2020 |
| JP | 2002188600 | A | 7/2002 |

OTHER PUBLICATIONS

Machine translation of CN 210686324, Andritz China LTD, published Jun. 5, 2020 (Year: 2020).*

* cited by examiner

ADJUSTABLE BLADE OF IMPELLER BUILT-IN ELECTRIC PUMP

CROSS REFERENCE TO THE RELATED APPLICATIONS

This application is the national phase entry of International Application No. PCT/CN2020/114549, filed on Sep. 10, 2020, which is based upon and claims priority to Chinese Patent Application No. 202010550947.5, filed on Jun. 16, 2020, the entire contents of which are incorporated herein by reference.

TECHNICAL FIELD

The present invention relates to the technical field of electric pump, and more particularly to an adjustable blade of an impeller built-in electric pump.

BACKGROUND

There are a variety of methods to adjust a blade of an electric pump that each differ in function, system structure, cost and reliability. Additionally, pumping stations with different structures have different requirements for an adjusting function of the blade. To effectively adjust the operating condition of the electric pump and keep the electric pump running in a high efficiency area, it is effective to adjust an angle of the blade of the electric pump.

The prior blade adjustment structure of the electric pump is complex, resulting in a high manufacturing cost of the electric pump and a high difficulty of installation and maintenance. Meanwhile, in an operation process of the electric pump, the prior blade adjustment structure of the electric pump is liable to be loose, resulting in a high damage rate of the electric pump.

SUMMARY (1) The Technical Problems to be Solved

The above problems can be solved by an adjustable blade of an impeller built-in electric pump of the present invention, which has a simple structure and can effectively shorten the axial length of the electric pump.

(2) Technical Solutions

An adjustable blade of an impeller built-in electric pump includes a blade body, where the blade body realizes an angle adjustment through a lever regulator structure. The lever regulator structure includes a control shaft arranged at a root of the blade body, the other end of the control shaft is connected to a crank, the other end of the crank is rotatably connected to one end of a connecting rod, the other end of the connecting rod is rotatably connected to an operating frame, and the operating frame is provided with a drive rod configured to drive the operating frame to move.

Specifically, the blade body adopts a spherical blade, and a small gap is formed between an outer side of the blade body and a spherical inner cavity of an inner side of a rotor inner ring, and the outer side of the blade body is provided with a drive shaft and a circular boss. A rotor drives the drive shaft to rotate through a first sliding bearing, and the blade body rotates in the spherical inner cavity of the inner side of the rotor inner ring through the first sliding bearing.

Specifically, the control shaft and the drive shaft are both cylindrical.

Specifically, the other end of the control shaft is connected to the crank through a second sliding bearing.

Specifically, an outer side of the rotor is provided with a stator assembly.

Specifically, an outer side of an impeller hub is provided with a guide blade.

According to the above technical solutions, the advantages of the present invention are as follows:

The present invention provides an adjustable blade of an impeller built-in electric pump, which has the advantages of being compact and simple, low manufacturing cost and low difficulty of installation and maintenance. Moreover, by adjusting the angle of the blade, the vibration during the start-up of the unit can be effectively reduced, which is beneficial to the start-up of the unit, and the requirements for start-up torque can be reduced. In this way, the efficient operation of the electric pump in different head ranges can be realized to meet the drainage needs of special cases.

Figure 1:
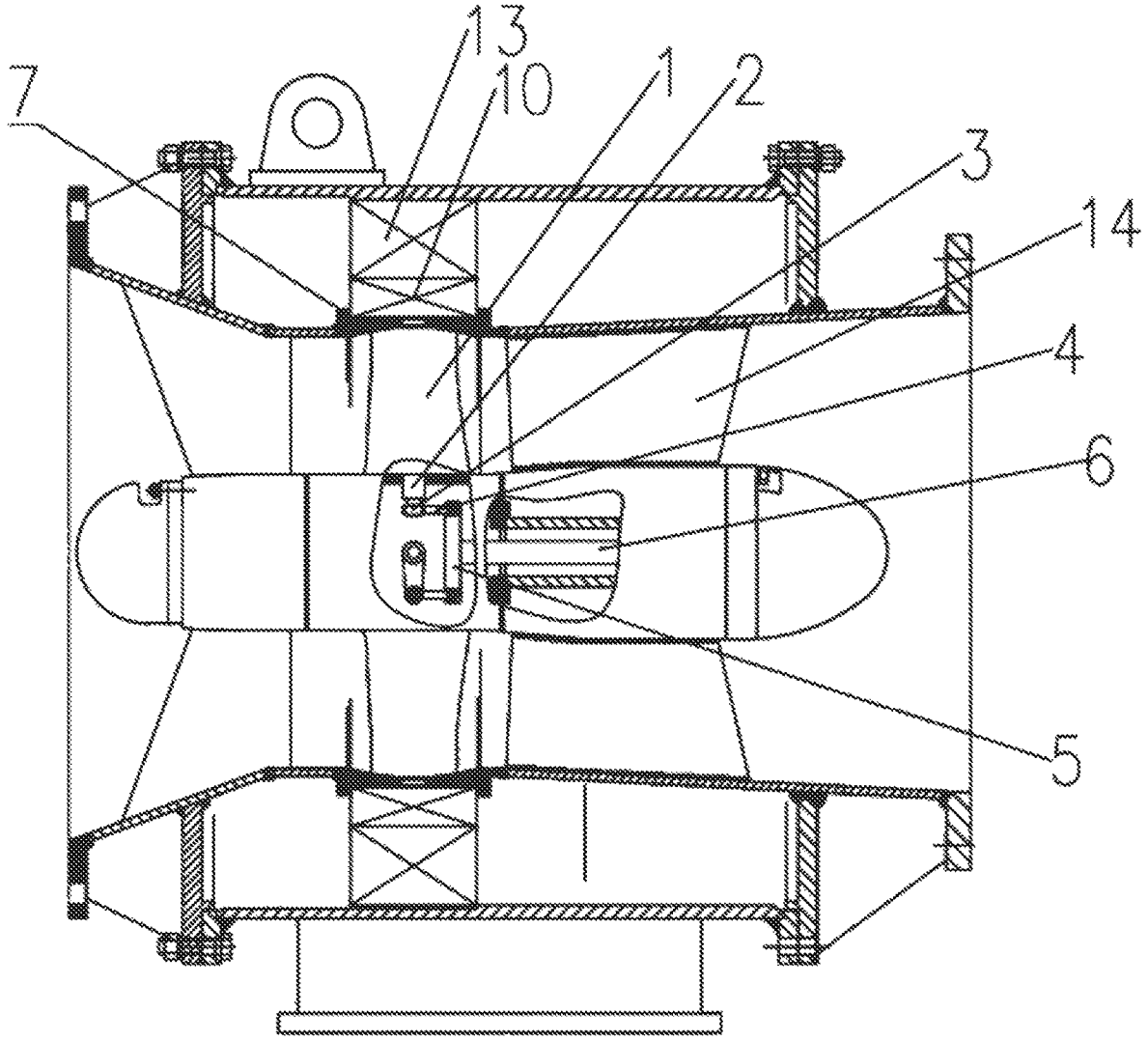
FIG. 1 is an overall schematic diagram of a structure of an impeller built-in electric pump according to an embodiment.

Reference numeral: blade body 1, control shaft 2, crank 3, connecting rod 4, operating frame 5, drive rod 6, rotor inner ring 7, drive shaft 8, circular boss 9, rotor 10, first sliding bearing 11, second sliding bearing 12, stator assembly 13, and guide blade 14.

DETAILED DESCRIPTION OF THE EMBODIMENTS

The implementation of the present invention is further described in detail below in conjunction with the drawings and an embodiment. The detailed description and drawings of the following embodiment are used to illustrate the principle of the present invention, but cannot be used to limit the scope of the present invention, that is, the present invention is not limited to the described embodiment, and includes any modification, replacement and improvement of parts, components and connection manners without departing from the spirit of the present invention.

It should be noted that the embodiment in the present invention and the features in the embodiment may be combined with each other without conflict. The present invention will be explained in detail below with reference to the drawings and in conjunction with the embodiment.

Embodiment

Figure 2:
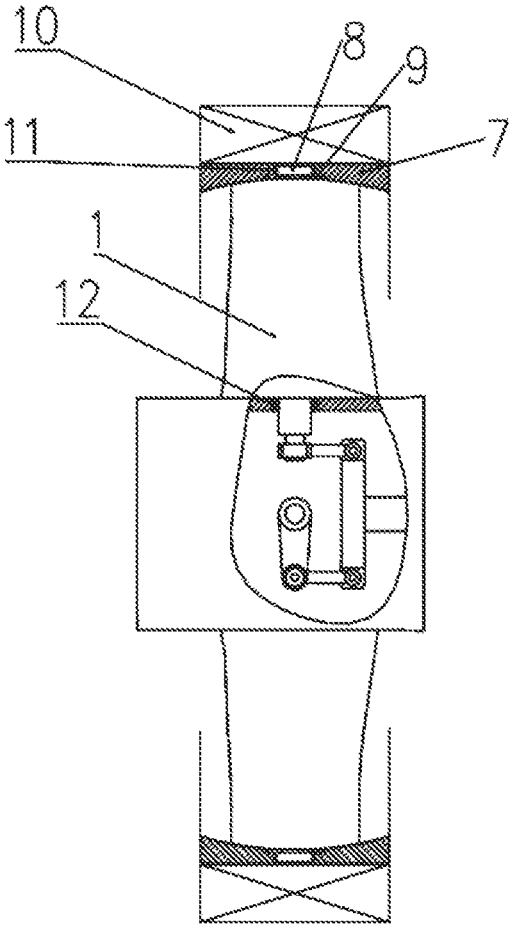
FIG. 2 is a schematic diagram of a structure of a rotor assembly according to an embodiment.
Figure 3:
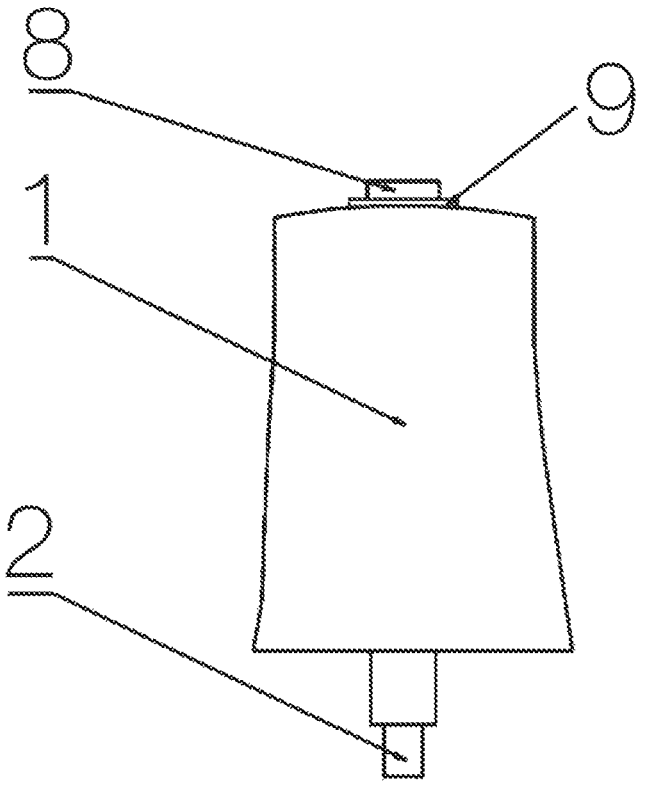
FIG. 3 is a schematic diagram of a structure of a blade body component according to an embodiment.
Figure 4:
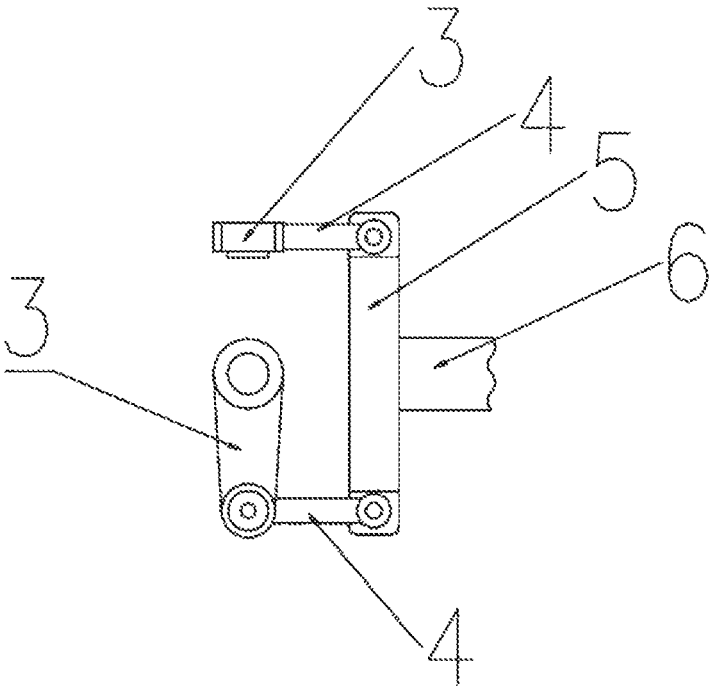
FIG. 4 is a schematic diagram of a structure of a blade adjusting component according to an embodiment.

As shown in FIGS. 1 to 4, an adjustable blade of an impeller built-in electric pump includes the blade body 1, where the blade body 1 realizes angle adjustment through a lever regulator structure. The lever regulator structure includes the control shaft 2 arranged at the root of the blade body 1, the other end of the control shaft 2 is connected to the crank 3 through the second sliding bearing 12, the other end of the crank 3 is rotatably connected to one end of the connecting rod 4, the other end of the connecting rod 4 is rotatably connected to the operating frame 5, and the operating frame 5 is provided with the drive rod 6 configured to drive the operating frame 5 to move.

In the present embodiment, the blade body 1 adopts a spherical blade, and a small gap is formed between the outer side of the blade body 1 and the spherical inner cavity of the inner side of the rotor inner ring 7, and the outer side of the blade body 1 is provided with the drive shaft 8 and the circular boss 9. The rotor 10 drives the drive shaft 8 to rotate through the first sliding bearing 11, and the blade body 1 rotates in the spherical inner cavity of the inner side of the rotor inner ring 7 through the first sliding bearing 11.

Specifically, the control shaft 2 and the drive shaft 8 are both cylindrical.

In the present embodiment, the outer side of the rotor 10 is provided with the stator assembly 13, and the outer side of the impeller hub is provided with the guide blade 14.

When the electric pump is running, the stator assembly 13, the guide blade 14 and the water suction chamber (not shown in the drawings) remain static, the rotor 10 rotates to drive the blade body 1 to rotate, and the rotor 10 is positioned and supported through the water suction chamber and the bearing of the guide blade 14 to bear its own weight, water thrust and axial force caused by blade adjustment. The blade body 1 of the electric pump adopts the spherical blade. In the inner cavity of the rotor ball, the blade body 1 can rotate along the drive shaft 8 on the outer side, and the rotor shaft is internally hollow, and is integrally connected to the impeller hub through a flange. A blade adjusting mechanism is arranged in the middle of the impeller hub to control the rotation of the control shaft 2 of the blade root, so as to realize the angle control of the blade body 1.

The above descriptions are only an embodiment of the present invention and is not limited to the present invention. The present invention may be subjected to various changes and modifications by those skilled in the art without departing from the scope of the present invention. Any modification, equivalent replacement, improvement, and the like, made within the spirit and principles of the present invention shall fall within the scope of the claims of the present invention.

What is claimed is:

1. An adjustable blade of an impeller built-in electric pump, comprising:

a blade body, wherein the blade body realizes an angle adjustment through a lever regulator structure, wherein further the blade body adopts a spherical blade, and a gap is formed between an outer side of the blade body and a spherical inner cavity of an inner side of a rotor inner ring, and the outer side of the blade body is provided with a drive shaft and a circular boss;

the lever regulator structure comprising a control shaft, wherein a first end of the control shaft is arranged at a root of the blade body, a second end of the control shaft is connected to a first end of a crank, a second end of the crank is rotatably connected to a first end of a connecting rod, a second end of the connecting rod is rotatably connected to an operating frame, and the operating frame is provided with a drive rod configured to drive the operating frame to move; and a rotor driving the drive shaft to rotate through a first sliding bearing, and the blade body rotates in the spherical inner cavity of the inner side of the rotor inner ring through the first sliding bearing.

2. The adjustable blade of the impeller built-in electric pump according to claim 1, wherein the control shaft and the drive shaft are both cylindrical.

3. The adjustable blade of the impeller built-in electric pump according to claim 1, wherein the second end of the control shaft is connected to the crank through a second sliding bearing.

4. The adjustable blade of the impeller built-in electric pump according to claim 1, wherein an outer side of the rotor is provided with a stator assembly.

5. The adjustable blade of the impeller built-in electric pump according to claim 1, wherein an outer side of an impeller hub is provided with a guide blade.

* * * * *